US005256117A

United States Patent [19]

Potts et al.

[11] Patent Number: 5,256,117

[45] Date of Patent: Oct. 26, 1993

[54] STAIRCLIMBING AND UPPER BODY, EXERCISE APPARATUS

[75] Inventors: Lanny Potts, Skiatook; deceased by Edmund J. Farrell, Tulsa; Fred H. Holmes, Tulsa, all of Okla.

[73] Assignee: Stairmaster Sports Medical Products, Inc., Kirkland, Wash.

[21] Appl. No.: 594,872

[22] Filed: Oct. 10, 1990

[51] Int. Cl.[5] ..... A63B 22/04; A63B 22/12

[52] U.S. Cl. ..... 482/52; 482/62

[58] Field of Search ..... 482/52, 53, 62, 900, 482/4, 5, 51

[56] References Cited

U.S. PATENT DOCUMENTS

| | | | |
|---|---|---|---|
| D. 191,792 | 11/1961 | Maratta | 482/62 |
| D. 321,229 | 10/1991 | Dalton . | |
| 441,881 | 1/1891 | Gardiner . | |
| 670,006 | 3/1901 | Raymond . | |
| 857,447 | 6/1907 | Cooper . | |
| 3,062,542 | 11/1962 | Evancha . | |
| 3,511,500 | 4/1967 | Dunn . | |
| 3,529,474 | 9/1970 | Olson . | |
| 3,589,193 | 6/1971 | Thornton . | |
| 3,592,446 | 7/1971 | Parsons . | |
| 3,592,465 | 7/1971 | Fulkerson, Jr. . | |
| 3,628,791 | 12/1971 | Garcia . | |
| 3,640,530 | 2/1972 | Henson . | |
| 3,701,529 | 10/1972 | Kruthaupt . | |
| 3,707,285 | 12/1972 | Martin . | |
| 3,716,231 | 2/1973 | Martin . | |
| 3,747,924 | 7/1973 | Champoux . | |
| 3,759,511 | 9/1973 | Zinkin . | |
| 3,759,512 | 9/1973 | Yount . | |
| 3,824,994 | 7/1974 | Soderberg, Sr. . | |
| 3,874,659 | 4/1975 | Aharoni . | |
| 3,896,673 | 7/1975 | Henson et al. . | |
| 3,929,331 | 12/1975 | Beeding . | |
| 3,970,302 | 7/1976 | McFee . | |
| 4,063,726 | 12/1977 | Wilson . | |
| 4,082,267 | 4/1978 | Flavell . | |
| 4,084,810 | 4/1978 | Forsman . | |
| 4,111,414 | 9/1978 | Roberts . | |
| 4,112,929 | 9/1978 | Putsch . | |
| 4,235,437 | 11/1980 | Ruis et al. . | |
| 4,325,547 | 4/1982 | Cook . | |
| 4,341,380 | 7/1982 | Sauder . | |
| 4,358,105 | 11/1982 | Sweeney . | |
| 4,436,097 | 3/1984 | Cunningham . | |
| 4,452,447 | 6/1984 | Lepley . | |
| 4,470,597 | 9/1984 | McFee . | |
| 4,496,147 | 1/1985 | DeCloux . | |
| 4,512,556 | 4/1985 | Bicocchi . | |
| 4,519,603 | 5/1985 | DeCloux . | |
| 4,555,108 | 11/1985 | Montiero . | |
| 4,563,001 | 1/1986 | Terauds . | |
| 4,576,539 | 3/1986 | Williams . | |
| 4,600,187 | 7/1986 | Schenker . | |
| 4,645,197 | 2/1987 | McFee . | |
| 4,659,075 | 4/1987 | Wilkinson . | |
| 4,676,501 | 6/1987 | Hoagland . | |
| 4,687,195 | 8/1987 | Potts . | |
| 4,708,338 | 11/1987 | Potts . | |
| 4,720,093 | 1/1988 | Del Mar . | |
| 4,842,268 | 6/1989 | Jenkins | 482/52 |
| 4,846,458 | 7/1989 | Potts . | |
| 4,923,193 | 5/1990 | Pitzen et al. . | |
| 4,934,692 | 6/1990 | Owens . | |
| 4,958,830 | 9/1990 | Huggins et al. | 482/52 |
| 5,016,870 | 5/1991 | Bulloch et al. | 482/52 |

FOREIGN PATENT DOCUMENTS

| | | |
|---|---|---|
| 475603 | 7/1951 | Canada . |
| 81304852.7 | 12/1982 | European Pat. Off. . |

OTHER PUBLICATIONS

Counsilman, J. "Isokinetic Exercise: A New Concept In Strength Building", 1969.

Katch, F. "Measuring Leg Force-Output Capacity with an Isokinetic Dynamometer-Bicycle Ergometer", *The Research Quarterly*, vol. 45, No. 1, Mar., 1974.

*Primary Examiner*—Stephen R. Crow

*Attorney, Agent, or Firm*—Townsend and Townsend

[57] ABSTRACT

An apparatus for simultaneous upper body exercise and lower body exercise is provided. The lower body exercise is of a stairclimbing simulation type. Movement of the upper body exercise handles and lower body exercise pedals are independent from one another. Resistance to motion of the handles and pedals is provided and controlled so as to produce substantially isokinetic exercise. Step-down gears are provided so that a similar amount of upper body effort and lower body effort is perceived by the exerciser.

36 Claims, 4 Drawing Sheets

STAIRCLIMBING AND UPPER BODY, EXERCISE APPARATUS

BACKGROUND OF THE INVENTION

The present invention relates to an exercise apparatus and in particular to an apparatus for simulating stairclimbing and for simultaneous upper body exercise.

Several devices are known for use in exercising which simulates stairclimbing. An example is U.S. Pat. No. 4,708,388 issued Nov. 24, 1987 to Potts (reissue application Ser. No. 411,803, filed Sep. 25, 1989). Typically, such stairclimbing devices are principally directed to lower body exercise. In some stairclimbing devices, gravity pulls the exerciser's body mass downward, and the user recovers by pushing his body mass up. The exerciser grasps stationary handles so that little, if any, upper body exercise occurs during the stairclimbing.

SUMMARY OF THE INVENTION

According to the present invention, an exercise device is provided which includes pedals for a stairclimbing simulation exercise and provides movable handles for simultaneous upper body exercise or toning. Preferably, left and right movable handles are provided which operate independently, i.e. such that motion of one handle is not invariably accompanied by motion of the other handle. Similarly, the left and right pedals are independent of each other and independent of the handles. In one embodiment, motion of the handles and pedals is conveyed to and summed into a rotatable shaft to cause rotation of the shaft. The resistance provided to movement of the handles, i.e. counterforce per unit of curvilinear handle travel, differs from the resistance offered by the pedals. In one embodiment, the ratio between handle arm movement and shaft angular velocity is about four times the ratio between pedal arm movement and shaft angular velocity.

The handles are attached to the remainder of the apparatus by movable bars. The handles are rotatably attached to the bars.

Preferably, a visual indicator is included which displays an indication of the calories expended or the work being done. In one preferred embodiment, the apparatus senses the work done using the handles, independently of the work done using the pedals, and displays an indication of the work which represents upper body exercise.

The resistance to movement which is offered by the handles and pedals is an adjustable resistance. In one embodiment, the resistance is adjusted to produce substantially isokinetic exercise. Preferably, the force required to move the pedal is somewhat lessened in the early part of pedal movement to accommodate the smaller power of the flexed knee compared to the extended knee. Accordingly, the chain or cable coupling the shaft to the pedals is connected at a point spaced from the longitudinal axis of the pedal arm.

The pedals are provided with a restoring force which lifts the pedal from the lower position to the upper position. This restoring force also tends to supply an upward force on the legs of the exerciser, thus giving a partial mechanical assist to the exerciser. In one embodiment, the apparatus provides a display of work or calories which includes the work done by the exerciser during the power stroke movements of the pedals and handles minus the work done by the apparatus on the exerciser, representing the assist which the apparatus provides to the exerciser.

DETAILED DESCRIPTION OF THE PREFERRED EMBODIMENTS

Figure 1:
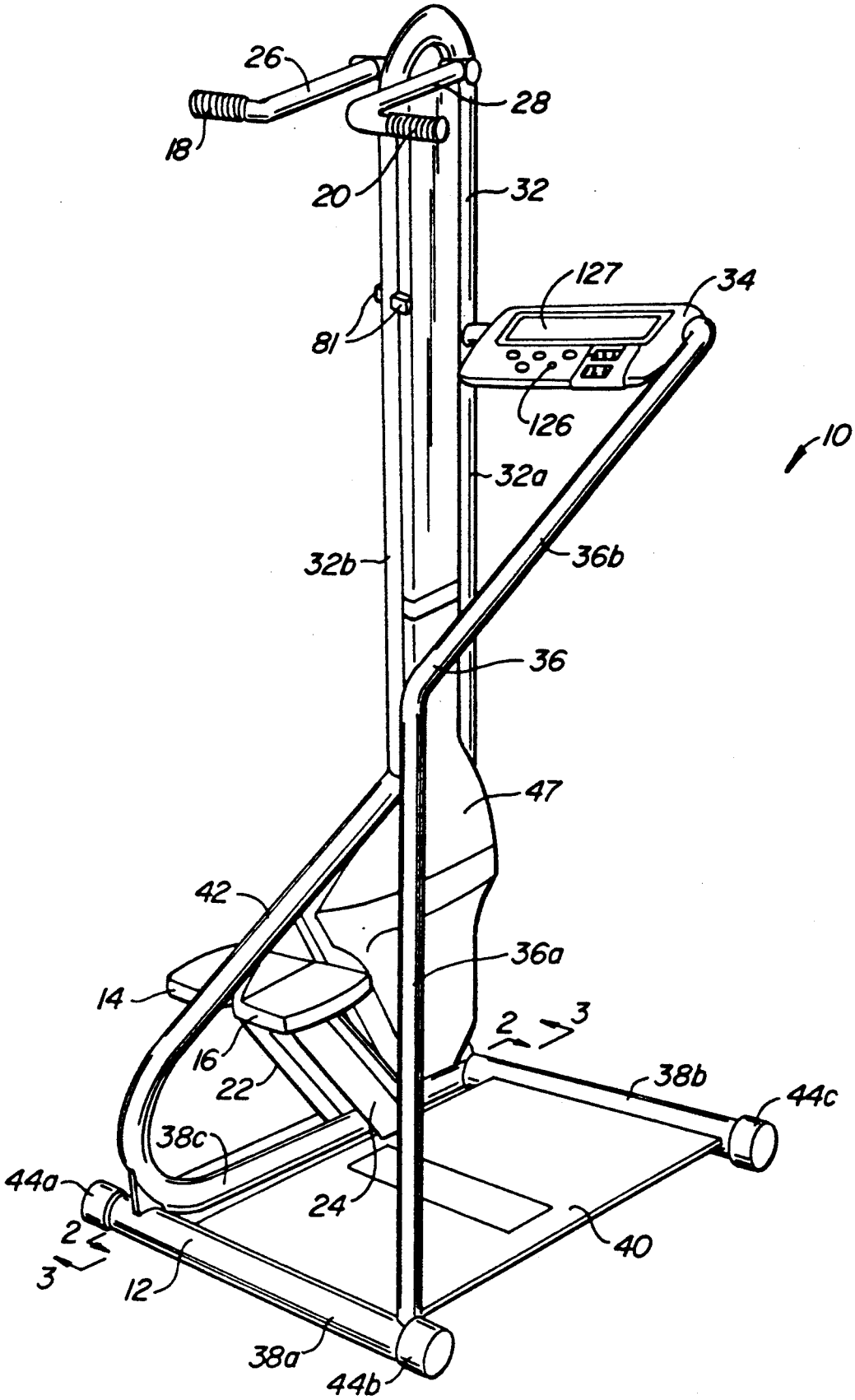
FIG. 1 is a perspective view of an exercise apparatus according to the present invention.

As seen in FIG. 1, the exercise apparatus 10 includes a base 12, left and right pedals 14, 16, and 1®ft and right handles 18, 20. The pedals 14, 16 are attached with respect to the base 12 by pedal arms 22, 24. The handles 18, 20 are attached with respect to the base 12 by handle arms 26; 28 which are pivotally attached to an upright member 32 extending upwardly from the base 12. An input/output unit 34 is attached to the apparatus in a position to be viewed and operated by an exerciser while standing on the pedals 14, 16 for example, by a rail 36 which is attached to the base 12.

The base 12, in the preferred embodiment, includes first and second crossbars 38*a*, 38*b* connected together by a longitudinal bar 38*c* and webbing 40. Four feet 44*a*, 44*b*, 44*c*, 44*d* are attached to the ends of the crossbars 38*a*, 38*b*. The longitudinal bar 38*c* preferably includes an upwardly inclined portion 42.

The upright 32 has a substantially inverted U-shape with legs 32*a*, 32*b* which attach to the ends of the longitudinal bar near the second cross bar 38*b* and the end of the inclined portion 42, respectively.

The rail 36 includes a first upwardly extending portion 36*a*, extending upwardly from the first crossbar 38*a* and an inclined portion 36*b* which attaches to the input/output (I/O) unit 34. The I/O unit 34 is also attached to the upright 32.

Preferably the crossbars 38*a*, 38*b*, longitudinal bar 38*c*, upright 32 and rail 36 are formed of a metallic material such as steel tubing with the chassis components joined together by welding. The handle arms 26, 28 are, preferably cast metal. Other materials could also be used for forming the bars, arms, upright, and rail including other types of metal such as aluminum, or non-metal materials such as fiberglass, impregnated or unimpregnated resins, plastics, ceramics, and wood. The components can be joined together by means other than welding including integral formation, brazing, soldering, bolting, screwing, adhesives and the like.

Figure 2:
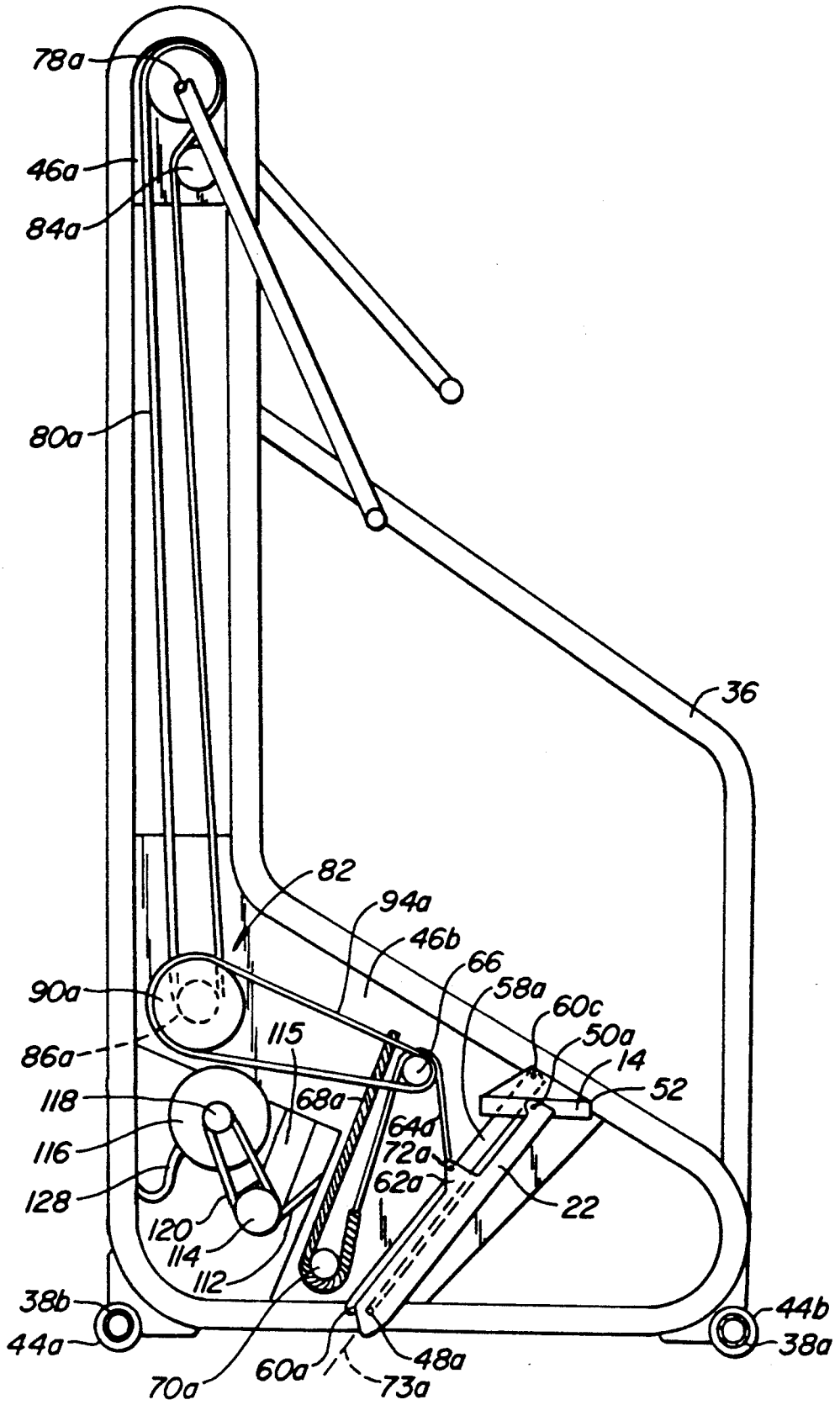
FIG. 2 is a cross-sectional view taken along line 2—2 of FIG. 1.

As seen in FIG. 2, first and second plates 46*a*, 46*b* extend between portions of the upright 32 and longitudinal bar 38*c* for mounting various components as described below. A cover 47, preferably formed of vacuum formed plastic, surrounds the items mounted on the plates 46*a*, 46*b* to improve the appearance of the apparatus 10 and to protect the user from moving parts.

Figure 3:
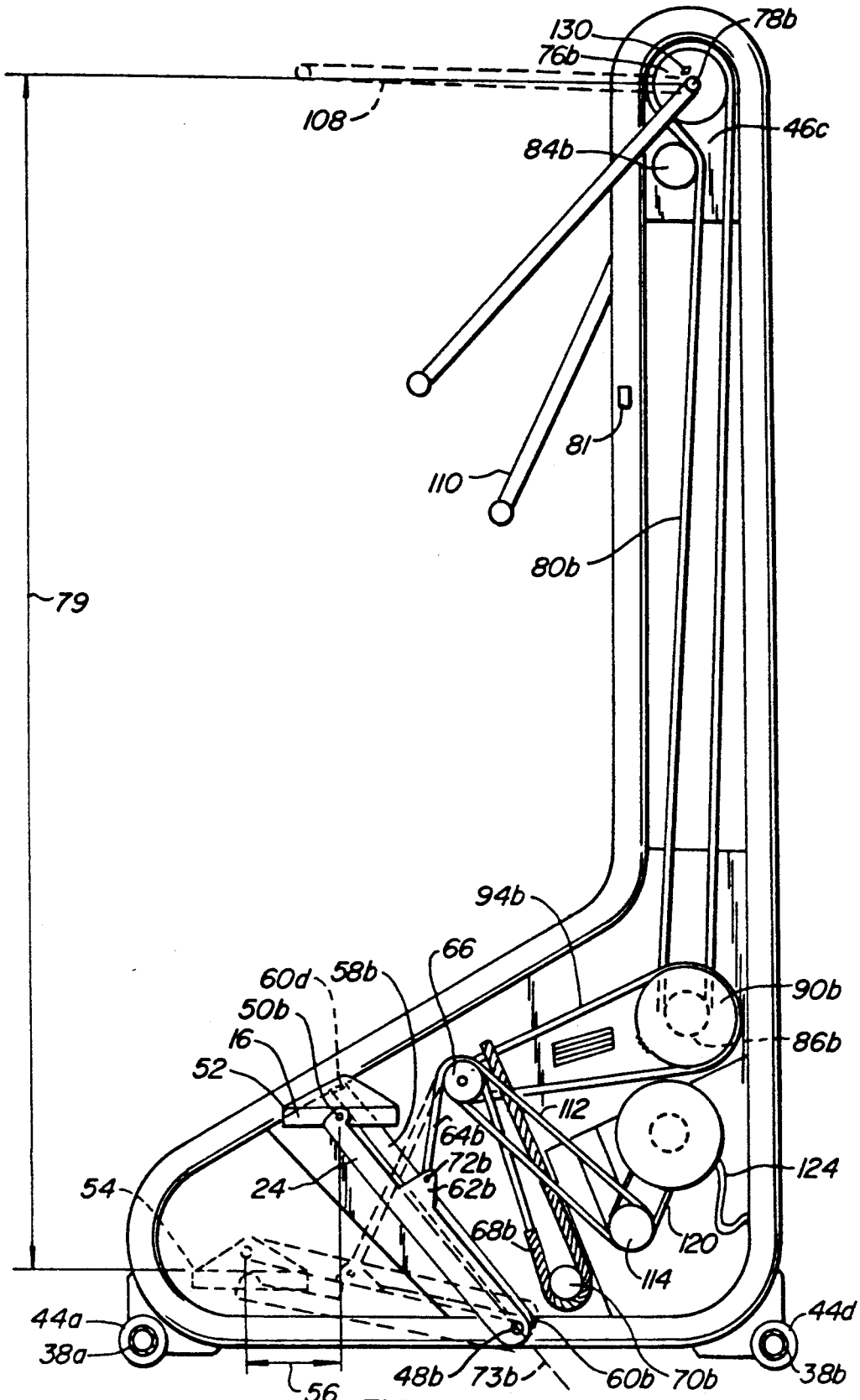
FIG. 3 is a cross-sectional view taken along line 3—3 of FIG. 1.

The pedals 14, 16 are preferably formed of a moldable material such as nylon or other plastic and the pedal arms 22, 24 are preferably cast iron. The pedals 14, 16 are provided with friction surfaces to avoid slipping. As best seen in FIGS. 2 and 3, the pedal arms 22, 24 are mounted to include two pivot points. The pedal arms 22, 24 pivot with respect to the base 12 about first pivot points 48*a*, 48*b* and pivot with respect to the pedals 14, 16 about second pivot points 50*a*, 50*b*. Pivoting of the pedal arms 22, 24 permits movement of the pedals 14, 16 from an upper position 52, depicted in solid lines in FIGS. 2 and 3 to a lower position 54, depicted in phantom lines in FIG. 3. As seen in FIG. 3, the lower position 54 is also displaced, with respect to the upper position 52 in a rearward direction, i.e. a horizontal direction away from the handles 18, 20 by a first amount 56.

During movement of the pedals 14, 16 the pedals are maintained in a substantially horizontal configuration by left and right leveler links 58*a*, 58*b*. The leveler links 58*a*, 58*b* are pivotally attached to the base 12 and pedals 14, 16 at pivot points 60*a*, 60*b*, 60*c*, 60*d* respectively.

The left and right pedal arms 22, 24 include leg members 62*a*, 62*b*. First and second pedal chains 64*a*, 64*b* extend from the legs 62*a*, 62*b* to the sprocketed drive shaft 66 and thence to a helical spring 68*a*, 68*b*, preferably an extension spring. The spring 68*a*, 68*b* travels round a pulley 70*a*, 70*b* and the far end of the spring 68*a*, 68*b* is fixed with respect to the plate 46*b*. As described more fully below, the chain 64*a*, 64*b* serves to transmit force from motion of the pedals 14, 16 to the shaft 66 and also transmits a restoring force from the spring 68*a*, 68*b* to the pedals 14, 16 urging the pedals to the upper position 52. The legs 62*a*, 62*b* serve to position the connection point with the chain 72*a*, 72*b* offset from the longitudinal axes 73*a*, 73*b* defined by the pedal arm pivot points 48*a*, 50*a*, 48*b*, 50*b* for varying the resistance force during pedal movement as described more fully below. The handles 18, 20 are mounted to the handle arms 26, 28 to provide for free rotation of the handles 18, 20 with respect to the handle arms 26, 28.

Rotatably mounted to the upper plate 46*a* are left and right upper sprockets 76*a*, 76*b*. The handle arms 26, 28 are attached to the upper sprockets 76*a*, 76*b* respectively so that movement of the arms 26, 28 causes rotation of the upper sprockets 76*a*, 76*b*. The upper arms 26, 28 can be attached using a keyed sliding sleeve and shaft connection employing, e.g., a woodruff key. Preferably the upper sprockets 76*a*, 76*b* are mounted to define collinear pivot points 78*a*, 78*b* such as by using bearings attached to a common shaft. It is also operatable, however, to place the pivoting axes 78*a*, 78*b* in a non-collinear or non-parallel configuration. The pivot points 78*a*, 78*b* are vertically displaced from the level of the pedal 14, 16 when in the lowest position 54 by a distance 79 of about six feet (about 1.8 meters).

In previous devices, some users shift a large proportion of their weight to their hands and thus partially support themselves on one or more handrails. This tendency detracted from the amount of lower body exercise being done. Furthermore, some exercisers grasped handrails in a position which tended to promote undesirable posture during exercise and/or to cause discomfort to the exerciser's back. By providing movable handles 18, 20 the exercise apparatus 10 prevents shifting an inordinate amount of weight to the hands and arms and assists the exerciser in maintaining proper posture during exercise. In one embodiment, the arms 26, 28 are provided with a stop to limit the extent of downward movement of the arms. One example of such a stop is the rubber bumper 81, depicted in FIG. 3.

Two continuous chains 80*a*, 80*b* partially extend around the upper sprockets 76*a*, 76*b* respectively for transmitting movement to a transfer device 82. Idler sprockets 84*a*, 84*b* position the chains 80*a*, 80*b* to avoid striking the upright 32. The sprockets 84*a*, 84*b* are preferably slideably mounted to the plate 46*a* to permit tensioning of the chains 80*a*, 80*b*.

Figure 4:
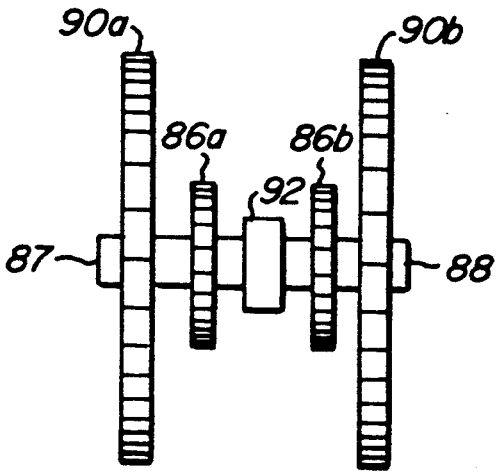
FIG. 4 is a top plan view of the transfer shafts and sprockets.

The transfer device 82, as best seen in FIG. 4 includes left and right smaller sprockets 86*a*, 86*b* fixedly attached to rotatable transfer shafts 87, 88 and left and right larger sprockets 90*a*, 90*b* also fixedly attached to the respective shafts 87, 88. A bearing 92 is provided for rotatably mounting the transfer device 82 on the second plate 46*b*. The two shafts 87, 88 are rotatable independently from each other. Intermediate chains 94*a*, 94*b* transmit rotation of the left and right larger sprockets 90*a*, 90*b* to the drive shaft 66.

Figure 5:
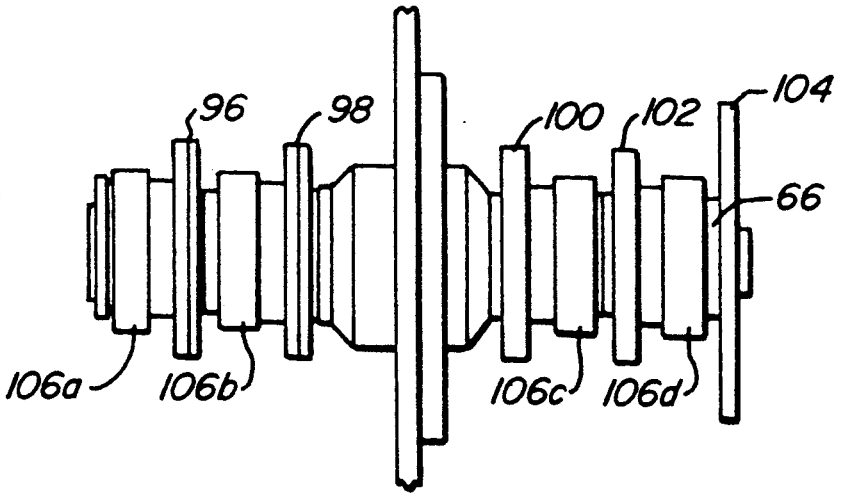
FIG. 5 is a top plan view of the drive shaft and sprockets.

As depicted in FIG. 5 attached to the drive shaft 66 are five sprockets 96, 98, 100, 102, 104. Two of the sprockets 96, 102 receive the left and right pedal chains 64*a*, 64*b*. Two other of the sprockets 98, 100 receive the left and right intermediate chains 94*a*, 94*b*. The first four sprockets 96, 98, 100, 102 are mounted to the shaft 66 by way of overrunning clutch devices 106*a*, 106*b*, 106*c*, 106*d*. The overrunning clutch devices 106*a*, 106*b*, 106*c*, 106*d* operate to transmit rotation of the sprockets 96, 98, 100, 102 to the shaft 66, when the sprockets 96, 98, 100, 102 are rotating in a power stroke direction. For each of the sprockets 96, 98, 100, 102 the rotation direction which is the power stroke direction relates to the corresponding direction of movement of the handles or pedals which drive rotation of the sprockets. In the preferred embodiment, the power stoke for the pedals is a stroke in the direction from the upper position 52 towards the lower position 54. The power rotation direction of the corresponding drive shaft sprockets 98, 100 is the direction the sprockets rotate during power stroke movement of the pedals 14, 16. The power stroke direction of the handles 18, 20 is the direction from the upper position 108, as shown in FIG. 3 in phantom lines, to the lower position 110. The power stroke rotation direction of the corresponding sprockets 96, 102 is the direction the sprockets rotate when the handles are moved in a power stroke direction.

The clutches 106*a*, 106*b*, 106*c*, 106*d* are configured to permit overrunning or slippage when the sprockets 96, 98, 100, 102 rotate in a direction opposite the power stroke direction, such as during the return movement of the pedals from the lower position 54 to the upper position 52 or the handles from the lower position 110 to the upper position 108. A number of overrunning clutch devices can be used including roller clutches, wrap spring clutches, or dog-and-pawl devices. In one preferred embodiment, clutch model RC-162110 provided by Torrington Co. is used.

The transmission of motion during power strokes of the handles 18, 20 is independent in the sense that motion of one of the handles is not necessarily accompanied by motion of the other handle. Thus, an exerciser can, if desired, exercise moving only one of the two handles or may exercise moving the two handles in different rhythms or different arc lengths. Similarly, power stroke motion of the pedals 14, 16 are independent in the sense that motion of one pedal is not necessarily accompanied by motion of the other pedal. In the preferred embodiment, the handles 18, 20 and pedals 14, 16 are independent in the sense that motion of any one of the handles 18, 20 or pedals 14, 16 is not necessarily accompanied by motion of any of the other of the handles 18, 20 and pedals 14, 16.

The fifth sprocket 104 is fixedly attached to the drive shaft 66 such that rotation of the drive shaft 66 causes rotation of the fifth sprocket 104. A drive chain 112 (FIG. 3) extends from the fifth sprocket 104 to a transmission 114. The transmission 114 is mounted on the second plate 46b by a bracket 115. The transmission 114 is preferably a speed-increasing transmission with a sufficient step-up ratio to convert the angular velocity of the drive shaft 66 to an angular velocity appropriate for driving an alternator 116. In one preferred embodiment, the transmission 114 provides a step-up ratio of about 18.75 to 1. The stepped-up output from the transmission 114 is coupled to the shaft 118 of the alternator 116 by a belt 120.

A controller, which is preferably the keyboard microprocessor 122, is connected to the alternator 116 by a cable 124 for receiving signals from the alternator 116 and for providing a selectable resistance load to the alternator 116. The microprocessor 122 is configured to sense a quantity related to the angular velocity of the alternator shaft 118. Preferably 6 AC cycles corresponds to one shaft revolution of the alternator. The microprocessor 122 selects a resistance to act as the load for the electric output generated by the alternator 116. The size of the resistance which acts as load for the alternator 116 determines the amount of work necessary to maintain a given angular velocity of the alternator shaft 118. In one preferred embodiment, the microprocessor 122 is configured to increase the resistance load whenever the angular velocity of the alternator shaft 118 (and, thus, the drive shaft 66) exceeds a preset and selectable value. In this configuration, the apparatus operates to maintain the alternator shaft 118 at a constant velocity, thus producing isokinetic exercise. The selected value for the level of isokinetic exercise, i.e., the preset threshold value of the angular velocity of the alternator shaft 118 is preferably selected using keys 126 on the I/O console 34.

The I/O console 34 includes keys 126 for permitting user input and a display 127 for providing visual output. Preferably, the I/O console 34 includes a processor 122 and a memory 123. The processor and memory are configured to permit the user to select one of several pre-programmed exercise regimes or to configure an individualized exercise regime. In one embodiment, the I/O unit 34 is configured to provide an indication of the amount of work done in upper body exercise independently of the amount of work done by lower body exercise. The amount of upper body exercise can be displayed by the I/O unit 34 as a number of calories expended in upper body exercise or as a percentage of the total calories represented by the upper body exercise. To determine the amount of upper body exercise, a strain gauge 130 such as model HBM6/120LY41 produced by Omega Co., is used. Output from the strain gauge 130 is provided to the I/O unit 34 by means of a cable not shown).

In operation, the user mounts the pedals 14, 16. The user's weight overcomes the restoring force of the helical spring 68a, 68b so that the pedals of the exerciser move to the lower position 54. The rail 36 may be employed as a handrail during mounting. The user uses the I/O console 34 to input a desired exercise regime. The I/O console 34 can be configured to permit a variety of possible selections. For example, the user may select the desired intensity of exercise, such as a desired number of calories per minute or a desired equivalent rate of climb in feet per minute, and a desired duration of exercise. In one embodiment, the user can select a variable exercise regime, such as a regime in which the intensity of exercise varies during the exercise. In one embodiment, the user inputs his or her body weight, e.g. for use by the processor in calculating calories expended. The user then inputs a command to begin the exercise.

The user grasps the handles 18, 20 and can begin exercising by moving any or all of the handles 18, 20 and pedals 14, 16.

As a user lifts a foot, e.g. a right foot, the helical spring 68b contracts and causes the pedal chain 64b to pull upwardly on the pedal arm 24 causing the pedal to rise from the lower position 54 to the upper position 52. This movement is the return stroke of the pedal 16. During the return movement, the motion of the chain 64 running over the sprocket 100 causes rotation of the sprocket 100 in the non-power direction. Because rotation is in the non-power direction, the corresponding clutch 106c, causes overrunning of the sprocket 100 with respect to the shaft 66 so that no rotational motion is conveyed to the shaft 66 as a result of the non-power stroke of the pedal 16.

The user then pushes down on the pedal 16 causing the pedal to move in the power stroke direction from the upper position 52 towards a lower position 54. The amount of force required to move the pedal a given distance in the power stroke direction depends on a number of factors. The pedal arm 24 can be viewed as a lever pivoting about a fulcrum 48b which acts to pull the pedal chain 64b. Thus, one factor which affects the force required to move the pedal is the moment arm of the lever. By connecting the chain 64b to a connection point 72b which is spaced from the longitudinal axis 73b of the pedal arm 24, the effective moment arm of the lever is changed during motion of the pedal arm 24. According to the present configuration, the attachment point 72b is selected such that the effective moment arm is smaller during the initial portion of pedal travel (i.e., in the region near the upper position 52) compared to the effective moment arm in lower positions of the pedal (i.e., in a direction towards the lower position 54) For this reason, the force required for a given curvilinear unit of pedal movement is less in the initial portions of pedal travel than in the lower portions of pedal travel. Such arrangement of decreased force requirements in the initial portion of pedal travel have been found useful for providing user comfort and avoiding user injury. Mechanical theory in existing research strongly suggests that this advantage occurs because the strength of the human leg is less when the knee is flexed then when it is more extended.

Power stroke movement of the pedal 16 causes the pedal chain 64b to extend the helical spring 68b, storing energy therein for returning the pedal to the upper position 52 as described above. As the chain 64b travels past the sprocket 100, it causes rotation of the sprocket in the power direction. Because the sprocket 100 rotates in the power direction, its rotation is transmitted to the shaft 66. Operation of the left pedal 14, pedal chain 64a and corresponding sprocket 98 is similar so that power stroke movement of the left pedal also produces rotation of the drive shaft 66.

When the user moves a handle, e.g. handle 20 from an upper position 108 towards a lower position 110, the handle sprocket 76b is caused to rotate, which in turn causes the handle chain 80a to move around the smaller sprocket 86b of the transfer device 82. Rotation of the smaller sprocket 86b causes rotation of the corresponding larger sprocket 90b in turn moving the intermediate chain 94b. Movement of the intermediate chain 94b causes rotation of the fourth sprocket 102 is attached to the drive shaft 66. Because the handle was moved in the power stroke direction, the fourth sprocket 102 is moved in the power rotation direction and accordingly the corresponding clutch 106d transmits the rotation of the sprocket 102 to the shaft 66 causing rotation thereof. When the handle 20 is moved from the lower position 110 towards the upper position 108, the corresponding movement of the fourth sprocket 102 is in a non-power direction and the clutch 106d overruns with respect to the shaft 66 so that no rotation is conveyed to the shaft 66.

The second handle 18, sprocket 74a, transmission 82, and intermediate chain 94a operate in a manner similar to the right handle 20 so as to cause rotation of the shaft 66 when the left handle 18 is moved in the power stroke direction and so as to cause overrunning of the first sprocket 96 with respect to the shaft 66 when the handle 18 is moved in the non-power stroke direction.

As a result of the movement of the pedals 14, 16 and handles 18, 20, all the power stroke movements are summed into a resulting rotation of the drive shaft 66. Rotation of the drive shaft 66 is conveyed by the chain 112 to the transmission 114 where it is stepped-up. The stepped-up output of the transmission is conveyed by the belt 120 to the shaft 118 of the alternator 116. Rotation of the alternator 116 results in production of electric energy which is conveyed by the cable 124 to the controller 122. The microprocessor 122 senses the angular velocity of the alternator shaft 118 and compares this angular velocity to a pre-selected angular velocity corresponding to a desired exercise level. If the angular velocity of the alternator shaft 118 exceeds the preset desired angular velocity, a higher value of resistance is selected as the load for the alternator 116. This higher load requires that a greater amount of work be done in order to further increase the angular velocity of the alternator shaft 118. By providing a sufficient increase in resistance, the apparatus can effectively maintain the angular velocity of the alternator shaft 118 at a constant value. Thus, in this configuration, the apparatus provides substantially isokinetic exercise in which the counterforce or resistance to movement which the pedals 14, 16 and handles 18, 20 offer the exerciser is continuously varied in order to maintain the apparatus at a constant velocity.

The size difference between the handle sprocket 76a and the smaller sprocket 86a of the transfer device 82 provides a first step-down ratio of about 2-to-1. Similarly, the size difference between the larger sprocket 90a of the transfer device 82 and the first sprocket 96 of the drive shaft 66 provides a second step-down ratio of about 2-to-1. Thus, there is a total step-down ratio of about 4-to-1 between the angular movement of the arm handle 26 and the resultant angular movement of the first sprocket 96, whereas there is no such corresponding step-down between angular movement of the pedal arm 22 and angular rotation of the second sprocket 98. Because the first and second sprockets 96, 98 have substantially similar diameters the ratio of handle arm angular mount to drive shaft angular rotation is about four times the ratio of pedal arm angular movement to drive shaft angular movement. This difference between the ratio of handle movement to drive shaft movement compared to the ratio of pedal movement to drive shaft movement is preferred because it has been found that an exerciser subjectively perceives arm movement as more strenuous than leg movement. By providing for the described step-down ratio, the typical exerciser subjectively perceives the lower body exercise and upper body exercise as being approximately equally strenuous.

In view of the description above, a number of advantages of the present invention are apparent. The present invention provides for simultaneous stairclimbing exercise and upper body exercise. The present invention provides for exercise in which movement of the handles and pedals is independent. The device can provide for substantially isokinetic exercise and can produce exercise which is perceived by the user as being of approximately equal strenuousness in the upper body and lower body. The device can be configured to produce a substantially constant simulated climb rate, a substantially constant MET rate and/or a substantially constant rate of calorie expenditure. The device can also be configured to provide for a rate of exercise which varies according to a predetermined or programmable plan.

Because the apparatus can be programmed to accept input of a desired simulated climb rate, MET rate or calorie expenditure, the subjectively-perceived effort for a given programmed exercise rate will be substantially the same on any such machine. Accordingly, an exerciser can exercise on a particular one of such devices during one exercise period and switch to another such device (e.g., in a different exercise facility or health club) during the next exercise period without a significant perceptible change in the amount of effort used during exercise (when the machines are programmed for the same rate). Because two persons with different body weights who exercise on devices which are programmed at, e.g., the same MET rate will subjectively perceive similar amounts of effort, the present devices are useful for providing similar exercise experiences despite physical differences. Two persons of different body weights can, for example, exercise on two devices of this invention at the same time and, provided the devices are programmed at the same MET rate, can exercise at substantially the same level of effort (subjectively perceived) even through the heavier person will be doing more work, because each is provided with an effective handicap which compensates for physical differences. In one embodiment, a plurality of the devices can be connected to simultaneously monitor the simulated climb of the various users. In this way it is possible for a number of users to race one another. Moreover, since the participants are effectively handicapped, persons with differing abilities who race in this manner have substantially equal chances of winning, despite disparities in abilities.

A number of variations and modifications can be used in connection with the described apparatus. Although in the described apparatus a single braking device (i.e., the variable resistance load on the alternator) is used, it is also possible to provide a separate braking device for the upper body exercise and lower body exercise or four separate brake devices, usable for each of the handles 18, 20 and pedals 14, 16. With such separate braking devices, the apparatus can be configured to provide separate programmably selectable resistance to each limb, e.g., for use in rehabilitation therapy. An exercise apparatus according to the present invention can be adopted to provide a range of hand and arm positions from below the heart to above the head. Although in the described embodiment the motion of the handles 18, 20 and the pedals 14, 16 are summed into rotary motion of a single shaft 66, it is possible to provide separate rotating shafts for each pedal 14, 16 and handles 18, 20. Although the described apparatus 10 contain a specified apparatus for conveying motion of the handles 18, 20 and pedals 14, 16 to the braking device 116, 122, particularly sprockets, chains, and belts, other means of transmitting motion can be used such as using belts and pulleys in place of chains and sprockets, using cables and spools, using directly driven generators, using gear devices, and the like. The handles 18, 20 can be spring-biased or articulating, rather than free-rotating. The arms can be provided with a locking mechanism to fix the arms in one or more positions, in which case the device can be used for exclusive lower-body exercise.

The apparatus 10 can be formed of materials other than the tubes and plates as described, including providing solid bars, frames, or a uni-body chassis. The apparatus 10 could be provided with resistance to lifting of the handles from the lower position 110 to the upper position 108. Similarly, the pedals with, e.g., provision of shoe devices could be provided with apparatus for establishing resistance to lifting the pedals 14, 16 which must be overcome by the exerciser. The controller 122 can be configured to provide exercise other than isokinetic or constant-MET exercise such as isotonic exercise. The belts or chains, 64, 80, 94, 120 can be provided with spring members for maintaining tension. Other devices for providing resistance to motion than the alternator and variable load can be used, such as friction brakes, flywheels, shock absorbers, pneumatic devices, particle brakes, eddy current brakes, and controlled motors. Although in the described apparatus 10 the handles 18, 20 move along a circular path, the handles can be configured to move along paths with other shapes such as linear or elliptical. A number of types of controllers can be used, including a hard-wired controller as well as a programmable processor or computer. Although several aspects of the apparatus 10 have been described, at least some aspects can be used without using others. For example, the apparatus can be provided with independently moving handles 18, 20 without using independently moving pedals 14, 16. The apparatus could be provided with a step-down ratio of handle movement (compared to pedal movement) without providing for isokinetic exercise.

Although the invention has been described by way of a preferred embodiment and certain variations and modifications, other variations and modifications can also be used, the invention being defined by the following claims.

What is claimed is:

1. Apparatus usable for stair-climbing simulation and upper body exercise comprising:

a base;

left and right pedals;

means for movably mounting said pedals with respect to said base to permit movement between an upper position and a lower, rearward position;

means for providing a first force opposing motion of said pedals from said upper position to said lower position;

mean for urging said left and right pedals from said lower to said upper position;

left and right handles; and means for movably mounting said handles with respect to said base to permit movement between a first and a second position, said movement between said first and second position being substantially independent from said means for urging.

2. Apparatus, as claimed in claim 1, further comprising:

shaft means rotationally mounted with respect to said base;

means for converting said movement of at least one of said left and right pedals and at least one of said left and right handles to rotational movement of said shaft means;

means for sensing a quantity related to the angular velocity of said shaft means; and means for providing said force with a magnitude to prevent said angular velocity exceeding a predetermined value.

3. Apparatus as claimed in claim 2, further comprising means for selecting said predetermined value.

4. Apparatus, as claimed in claim 1, wherein said means for movably mounting said handles comprises:

a pivot means positioned with respect to said base;

left and right arms extending from said pivot means;

means for rotatably attaching said handles to said arms.

5. Apparatus, as claimed in claim 1, further comprising means for receiving user input, for calculating the amount of calories expended in said movement of said pedals and said handles and for displaying a quantity related to said calculated amount of calories.

6. Apparatus, as claimed in claim 1, further comprising:

means for sensing a quantity related to the amount of calories expended in said movement of said handles and for displaying a quantity related to said amount of calories.

7. Apparatus, as claimed in claim 1, further comprising means for maintaining said pedals in a substantially horizontal position during said movement between said upper and said lower position.

8. Apparatus, as claimed in claim 1, further comprising means for varying said first force during said motion of said pedals to provide a force which is smaller when said pedal is in a first pedal position than when said pedal is in a second pedal position, said first position being closer to said upper position than is said second position.

9. Apparatus, as claimed in claim 1, further comprising stop means for limiting the range of movement of said handles.

10. Apparatus, as claimed in claim 1, further comprising:

means for providing a second force opposing said movement of said handles from said first position to said second position.

11. Apparatus, as claimed in claim 10, further comprising:

means for adjusting said first force and said second force to produce substantially isokinetic exercise.

12. Apparatus, as claimed in claim 10, wherein said first force per unit of pedal movement is greater than said second force per unit of handle movement.

13. Apparatus usable for stair-climbing simulation and upper body exercise comprising:

a base;

left and right pedals mounted with respect to said base to permit movement between an upper position and a lower, rearward position;

means for opposing motion of said pedals from said upper position to said lower position;

mean for urging said pedal means from said lower to said upper position;

a left handle mounted with respect to said base to permit movement between a first and a second position;

a right handle mounted with respect to said base to permit movement between third and a fourth position, said movement between said first and second positions being substantially independent from said movement between said third and said fourth positions.

14. Apparatus, as claimed in claim 13, further comprising means for maintaining said pedals in a substantially horizontal position during said movement between said upper and said lower position.

15. Apparatus, as claimed in claim 13, further comprising means for varying said first force during said motion of said pedals to provide a force which is smaller when said pedal is in a first pedal position than when said pedal is in a second pedal position, said first position being closer to said upper position than is said second position.

16. Apparatus, as claimed in claim 13, further comprising:

means for providing a second force opposing said movement of said handles from said first position to said second position.

17. Apparatus, as claimed in claim 16, further comprising:

means for adjusting said first force and said second force to produce substantially isokinetic exercise.

18. Apparatus usable for stair-climbing simulation and upper body exercise comprising:

a base;

a left pedal mounted with respect to said base to be movable between a first pedal position and a second pedal position, said second position being below said first pedal position;

a right pedal mounted with respect to said base to be movable between a third pedal position and a fourth pedal position, said third position being below said fourth pedal position, said movement between said first and second pedal positions being substantially independent from said movement between said third and said fourth positions;

a left handle mounted with respect to said base to permit movement between a first and a second position; and a right handle mounted with respect to said base to permit movement between a third and a fourth position.

19. Apparatus, as claimed in claim 18, further comprising means for maintaining said pedals in a substantially horizontal position during said movement between said upper and said lower position.

20. Apparatus, as claimed in claim 18, further comprising means for varying said first force during said motion of said pedals to provide a force which is smaller when said pedal is in a first pedal position than when said pedal is in a second pedal position, said first position being closer to said upper position than is said second position.

21. Apparatus, as claimed in claim 18, further comprising:

means for providing a second force opposing said movement of said handles from said first position to said second position.

22. Apparatus, as claimed in claim 21, further comprising:

means for adjusting said first force and said second force to produce substantially isokinetic exercise.

23. Apparatus usable for stair-climbing simulation and upper body exercise comprising:

a base;

left and right pedals;

means for movably mounting said pedals with respect to said base to permit movement between an upper position and a lower, rearward position;

left and right handles;

means for movably mounting said handles with respect to said base to permit movement between a first and a second position;

shaft means rotationally mounted with respect to said base;

means for converting said movement of at least one of said left and right pedals to rotational movement of said shaft means to define a first ratio between distance traveled by said pedal and angular velocity of said shaft means;

means for converting said movement of at least one of said left and right handles to rotational movement of said shaft means to define a second ratio between distance traveled by said handle and angular velocity of said shaft means, said second ratio being greater than said first ratio.

24. Apparatus, as claimed in claim 23, wherein said second ratio is about four times said first ratio.

25. Apparatus, as claimed in claim 23, wherein said means for converting movement of at least one of said left and right handles comprises at least a first gear having a first diameter coupled to at least one of said left and right handles for receiving motion generated by movement of said one of said left and right handles and at least a second gear coupled to said first gear having a diameter greater than said first diameter.

26. Apparatus usable for stair-climbing simulation and upper body exercise comprising:

a base;

left and right pedals;

means for movably mounting said pedals with respect to said base to permit movement between an upper position and a lower, rearward position;

means for providing a first force opposing motion of said pedals from said upper position to said lower position;

mean for urging said pedal means from said lower to said upper position;

left and right handles;

means for movably mounting said handles with respect to said base to permit movement between a first and a second position;

means for sensing a quantity related to the amount of calories expended in said movement of said handles, independent of calories expended in said movement of said pedals, and for displaying a quantity related to said amount of calories expended in said movement of said handles.

27. An exercise apparatus for simultaneously conducting stair-climbing exercise and upper-body exercise, comprising:

a base;

left and right pedals;

left and right pedal arms for movably connecting said pedals to said base to permit movement between an upper position and a lower, rearward position, said movement of said left pedal being independent from said movement of said right pedal;

left and right handles;

left and right handle arms for movably connecting said handles to said base to permit movement between first and second positions, said movement of said left handle being independent of said movement of said right handle and also being independent from said movement of said pedals;

a shaft;

means for transmitting said movement of said pedals to said shaft to cause rotation of said shaft during said movement from said upper position to said lower position to define a first ratio between distance traveled by said pedals and angular velocity of said shaft;

means for transmitting said movement of said handles to said shaft to cause rotation of said shaft during said movement from said first position to said second position to define a second ratio between distance traveled by said handles and angular velocity of said shaft, said second ratio being greater than said first ratio;

means for urging said pedals from said lower position to said upper position; and means for selectively braking said rotation of said shaft to produce substantially isokinetic exercise.

28. Apparatus, as claimed in claim 27, wherein said means for transmitting said movement of said pedals includes a first linear means having a first end and a second end, and wherein said pedal arms are pivotable about a first axis with respect to said base and a second axis with respect to said pedals, said first and second axes defining a longitudinal axis and further comprising:

engagable means coupled to said shaft for causing rotation of said shaft when said linear means moves past said engagable means;

a first leg extending outward from at least one of said pedal arms; and means for attaching said first end to said leg at a point spaced from said longitudinal axis.

29. Apparatus usable for stair-climbing simulation comprising:

a base;

left and right pedals;

means for movably mounting said pedals with respect to said base to permit movement between an upper position and a lower, rearward position;

means for providing a first force opposing motion of said pedals from said upper position to said lower position;

means for providing a second force urging said pedal means from said lower to said upper position;

means for sensing a first quantity related to the amount of calories expended in said movement of said pedal means from said upper position to said lower position;

means for providing a binary code related to the magnitude of said second force;

means for using said first quantity and said signal to provide a third quantity related to an amount of calories expended offset by an amount of work done using said second force; and means for displaying a quantity related to said third quantity.

30. Apparatus, as claimed in claim 10, wherein said means for providing a second force comprises a chain.

31. Apparatus, as claimed in claim 1, wherein said apparatus further comprises a rotor, rotatably mounted with respect to said base and mean for maintaining the rotor at a substantially constant velocity.

32. Apparatus, as claimed in claim 31, wherein said means for maintaining includes a rotor velocity sensor and a processor, coupled to said sensor, for increasing a resistance load when said velocity exceeds a threshold value.

33. Apparatus, as claimed in claim 32, further comprising user input means, coupled to said processor, for use in selecting said threshold value.

34. Apparatus, as claimed in claim 33, wherein said user input means is configured to permit the user to select one of several pre-programmed exercise regimes.

35. Apparatus, as claimed in claim 33, wherein said user input means is configured to permit the user to configure an individualized exercise regime.

36. Apparatus, as claimed in claim 32, further comprising an alternator positioned with respect to said base, wherein said rotor is an alternator shaft and wherein said sensor senses AC output of said alternator.

* * * * *